US005368350A

United States Patent [19]

Ader et al.

[11] Patent Number: 5,368,350

[45] Date of Patent: Nov. 29, 1994

[54] GOLF BALL RETRIEVER

[76] Inventors: Vern Ader, 2988 Gruenwald Rd., Mosinee, Wis. 54455; Myron Dohm, 2496 Short Rd., Auburndale, Wis. 54412

[21] Appl. No.: 89,746

[22] Filed: Jul. 9, 1993

[51] Int. Cl.[5] ..... A63B 47/02

[52] U.S. Cl. ..... 294/19.2; 294/66.1

[58] Field of Search ..... 294/19.1, 19.2, 50.9, 294/66.1; 273/32 B, 32 F, 162 E; 56/328.1, 332, 337

[56] References Cited

U.S. PATENT DOCUMENTS

| | | | |
|---|---|---|---|
| 2,270,632 | 1/1942 | Hasty | 294/19.2 |
| 3,046,044 | 7/1962 | Christle | 294/19.2 |
| 3,547,477 | 12/1970 | Young | 294/19.2 |
| 3,614,149 | 10/1971 | Clark | 294/19.2 |
| 3,717,371 | 2/1973 | Halone | 294/19.2 |
| 3,770,308 | 11/1973 | Faber et al. | 294/19.2 |
| 3,889,996 | 6/1975 | Campbell | 294/19.2 |
| 4,136,901 | 1/1979 | Walter | 294/19.2 |
| 4,411,463 | 10/1983 | Alderman | 294/19.2 |
| 4,635,987 | 1/1987 | Hurtgam | 294/19.2 |
| 4,730,859 | 3/1988 | Gabinet | 294/19.2 |
| 4,957,319 | 9/1990 | Bontempo | 294/19.2 |
| 5,110,168 | 5/1992 | Petrillo | 294/19.2 |

*Primary Examiner*—Dean J. Kramer

[57] ABSTRACT

An improved multiple purpose golf ball retriever for retrieving golf balls from water hazards. The device comprises an elongated head which has a forward frame, upper frame, sliding rod and side frames. The elongated head can be permanently attached to a telescoping handle, adjusted in any position for use and storage in the golf bag and is accessible for retrieving when needed. The sliding rod which moves in angled sliding rod guides enables the golf ball retriever to capture the ball by going down over the ball. The retriever can be used as a rake in clear or out of view locations and from the top down when rocky, weedy or hazardous water areas restrict the raking action which provides the golf ball retriever with a large margin of error for capturing the golf ball from above or by raking.

1 Claim, 2 Drawing Sheets

FIG. 3
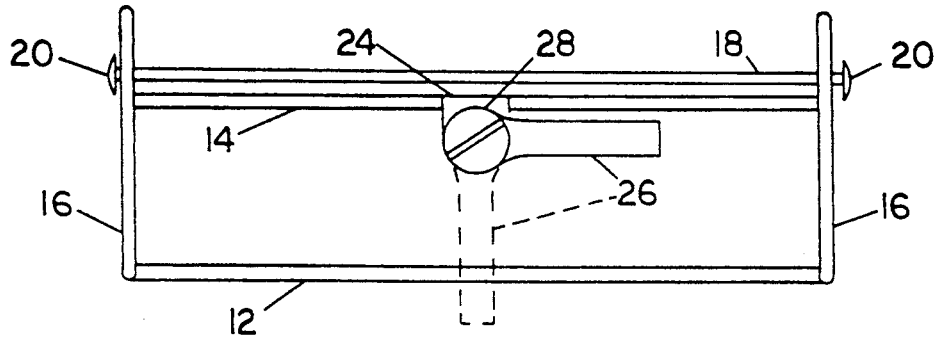
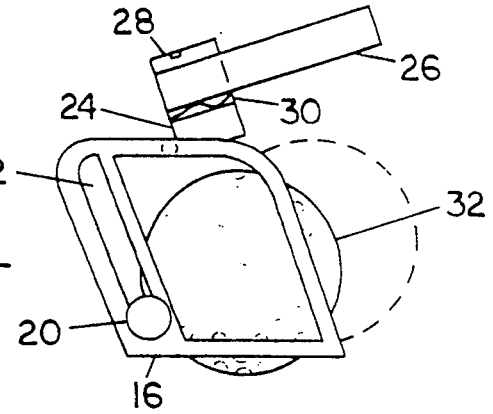
FIG. 4
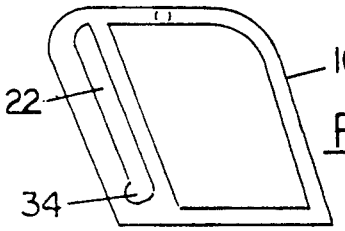
FIG. 5
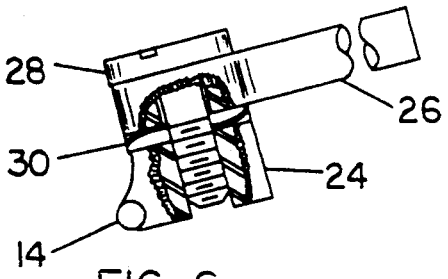
FIG. 6
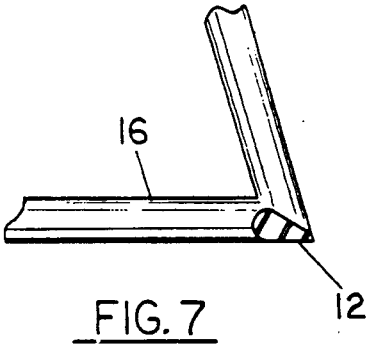
FIG. 7

GOLF BALL RETRIEVER

BACKGROUND

1. Field of the Invention

This invention relates to golf ball retrievers, specifically to an improved mechanism for retrieving golf balls from water hazards.

2. Description of Prior Art

The prior art has various devices for scooping or raking a golf ball from a water hazard or other inaccessible areas. Recent prior art has raking devices to retrieve the ball when the operator is unable to see the ball. U.S. Pat. Nos. 4,635,987 to Hurtgam, (1987), 4,730,857, to Gabinet, (1988), 4,957,319, to Boatempo, (1990), and 5,110,168, Petrillo, (1992). All four of these retrieving devices operate almost identically. They rake for the ball in clear or blind water areas and capture the ball to be retrieved. Although these golf ball retrievers are capable of entrapping the golf ball in many hazards, they are limited to a raking action and the golf ball entry from the front entrance. Rocky, weedy, or hazardous water areas restrict the raking action even when the ball is visible. Also, all of the previous retrievers have non-adjustable, fixed or detachable heads which must be removed for storage in the golf bag. This is an inconvenience and time factor that slows play on golf courses.

OBJECTS AND ADVANTAGES

Accordingly, several objects and advantages of the present invention are:

(a) To provide a multi purpose golf ball retriever to which the elongated head part can be permanently attached to a telescoping handle, adjusted in any position for use and storage in the golf bag and is readily accessible for instant retrieving when needed.

(b) To provide a golf ball retriever which can capture the ball by raking in clear or out of view locations from the user.

(c) To provide a golf ball retriever which can capture the ball from the top going down over the ball.

(d) To provide a golf ball retriever which has a large margin of error for retrieving the golf ball from above or raking.

Further objects and advantages are to provide a golf ball retriever which is simple to store, use, inexpensive to manufacture and which can be supplied for ease of mounting on a telescoping handle. Still further objects and advantages will become apparent from a consideration of the ensuing description and drawings.

DRAWING FIGURES

In the Drawings:

FIG. 3 is a top view of the golf ball retriever showing the handle mount in the closed or storage position.

FIG. 4 is an end view of the head part of FIG. 1 showing a golf ball seated between the forward frame and sliding rod after entering the mouth opening.

FIG. 5 is an end view of a side frame showing the sliding rod in the locked position when a golf ball rests on the sliding rod and forward frame.

FIG. 6 shows an end view of the head swivel, handle mount, friction device and fastening device.

FIG. 7 shows an end view of the forward frame with an optional lead angle.

Reference Numerals in Drawings

Figure 1:
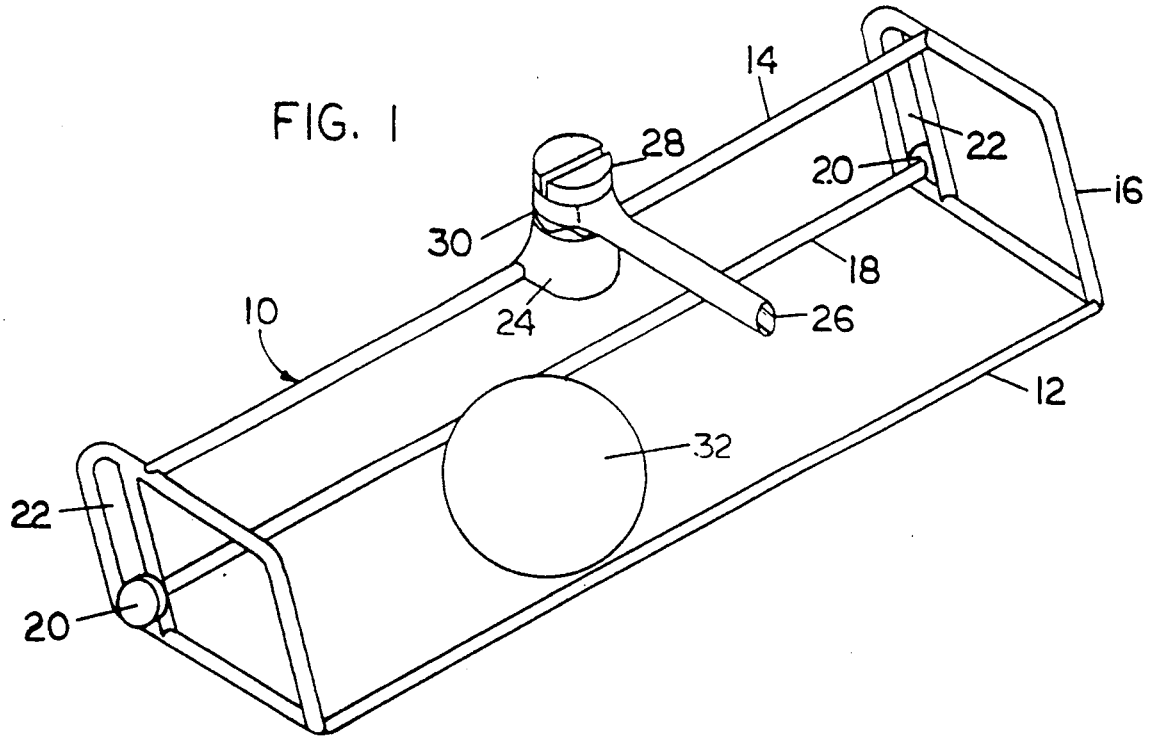
FIG. 1 is a perspective view of an elongated head part of a golf ball retriever according to the invention.

10 head
12 forward frame
14 upper frame
16 side frames
18 sliding rod
20 sliding rod end caps
22 sliding rod guides
24 head swivel
26 handle mount
28 fastening device
30 friction device
32 ball
34 sliding rod lock
36 telescoping handle

DESCRIPTION—FIGS. 1 to 7

FIG. 1 shows a perspective view of a typical embodiment of a head part 10 of the present invention. The head part 10 has an elongate shape and includes a forward frame part 12 and an upper frame part 14. A sliding rod part 18, with slide rod end caps 20, moves in the side frames 16 that have sliding rod guides 22, The retrieved ball 32 rests between the forward frame part 12 and the sliding rod 18. The head swivel 24 has a handle mount 26 which has a fastening device 28 and a friction device 30 as shown in FIG. 6.

The forward frame part 12 and upper frame part 14 are fastened to the side frames parts 16. The space between forward frame part 12 to the upper frame part 14 is larger than the diameter of a golf ball to permit entry of the golf ball 32. The forward frame part 12 to rear sliding rod 18 and sliding rod 18 to upper frame part 14 distance is less than the diameter of a golf ball to secure the ball 32 after it is retrieved.

Figure 2:
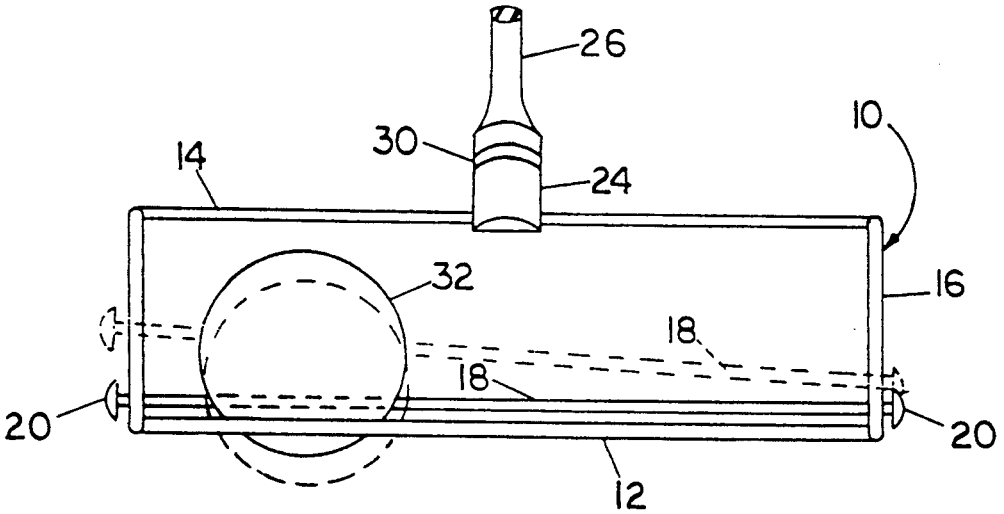
FIG. 2 is a front view of the golf ball retriever showing the sliding rod movement in the side frame guides.

As shown on FIG. 2 the sliding rod 18 can move at an angle up the side frames 16 in the sliding rod guides 22 which varies the opening between the forward frame part 12 and the sliding rod 18. This permits the golf ball 32 to be retrieved from the top by lowering the head part 10 over the ball 32. When the sliding rod 18 touches the golf ball 32 it rises in the sliding rod guide part 22 increasing the space between the forward frame part 12 and sliding rod 18 until the space is greater than the diameter of the golf ball 32 causing the sliding rod 18 to instantaneously drop over the golf ball 32 and return to the bottom of the sliding rod guide parts 22. The space between the forward frame part 12 and the sliding rod 18 is now smaller than the diameter of a golf ball 32 and the golf ball 32 is retrieved. As shown on FIG. 4 the weight of the golf ball 32 resting between the forward frame part 12 and the sliding rod 18 causes the sliding rod 18 to hold its position in the sliding rod locks 34 as shown in FIG. 5. The sliding rod ends 20 and sliding rod guides 22 have sufficient clearance to allow either end of the sliding rod 18 to move up and down the sliding rod guides 22 independently or simultaneously. This flexibility allows the golf ball retriever head 10 to be lowered over a golf ball 32 any place on the heads 10 elongated area or off to either side which provides a large margin for error in retrieving the golf ball 32 from above.

FIG. 6 shows that the head swivel 24, handle mount 26, fastening device 28 and friction device 30 are designed to allow adjustment of the head 10, in relationship to the telescoping handle, in any position for use or storage.

FIG. 7 shows that the forward frame part 12 can be shaped at an angle to facilitate the golf ball entrance into the head 10.

Although the description above contains many specifications, these should not be construed as limiting the scope of the invention but as merely providing illustrations of some of the presently preferred embodiments of this invention. For example the sliding rod and sliding rod guides can be placed in different locations of the head to accomplish the same purpose of retrieving a golf ball from above.

Thus the scope of the invention should be determined by the appended claims and their legal equivalents, rather than by the example given.

We claim:

1. A golf ball retriever comprising:

a) an elongate head for retrieving golf balls from a body of water, said head having a forward frame with a parallel rear sliding rod spaced therefrom to provide support for a retrieved golf ball;

b) the forward frame having a forward portion and an upper portion with the distance therebetween being wider than the diameter of a golf ball while the distance between the forward portion and the rear sliding rod and the distance between the rear sliding rod and the upper frame portion are less than the diameter of a golf ball;

c) a pair of side frame means for connecting the forward portion and the upper portion, a pair of sliding rod guides having angled guide openings and a recessed bottom to provide a means for the sliding rod to widen in relationship to the forward portion to accept and retrieve a golf ball and then locking the sliding rod in the recessed bottom when the golf ball is resting on the forward portion and the sliding rod;

d) a means for adjustably fixing a head swivel to a handle for providing selective movement about a single point and within a single plane;

e) whereby a golf ball is caused to enter the forward frame when the head is pulled against the golf ball, or, alternatively, when the head is lowered over a golf ball, the golf ball causes the sliding rod to slide within the sliding rod guides increasing the opening between the forward portion and the sliding rod until the sliding rod passes over the diameter of the golf ball and then drops to the recessed bottom thereby trapping the golf ball.

* * * * *